US006199588B1

(12) United States Patent
Shapiro

(10) Patent No.: US 6,199,588 B1
(45) Date of Patent: Mar. 13, 2001

(54) SERVOVALVE HAVING A TRAPEZOIDAL DRIVE

(75) Inventor: Wayne D. Shapiro, Chandler, AZ (US)

(73) Assignee: Delaware Capital Formation, Inc., Wilmington, DE (US)

( * ) Notice: Subject to any disclaimer, the term of this patent is extended or adjusted under 35 U.S.C. 154(b) by 0 days.

(21) Appl. No.: 09/449,423

(22) Filed: Nov. 23, 1999

(51) Int. Cl.[7] ..... F15B 13/044

(52) U.S. Cl. ..... 137/625.65; 251/129.03; 251/129.12

(58) Field of Search ..... 137/625.65; 251/129.03, 251/129.12

(56) References Cited

U.S. PATENT DOCUMENTS

| | | |
|---|---|---|
| 1,910,876 | 5/1933 | Appel . |
| 2,797,706 | 7/1957 | Harrison . |
| 3,550,631 | 12/1970 | Vanderlaan et al. . |
| 4,503,888 | 3/1985 | Brovold . |
| 4,573,494 | 3/1986 | Spurbeck . |
| 4,672,992 | 6/1987 | Vanderlaan et al. . |
| 4,742,322 | 5/1988 | Johnson et al. . |
| 4,793,377 | 12/1988 | Haynes et al. . |
| 4,825,904 | 5/1989 | Grau et al. . |
| 4,872,358 | 10/1989 | Buis . |
| 5,040,568 | 8/1991 | Hair et al. . |
| 5,052,441 | 10/1991 | Hair et al. . |
| 5,063,966 | 11/1991 | Amico et al. . |
| 5,263,680 | 11/1993 | Laux . |
| 5,263,681 | 11/1993 | Laux . |
| 5,504,409 | 4/1996 | Elrod, Jr. . |
| 5,551,482 | 9/1996 | Dixon et al. . |
| 5,573,036 | 11/1996 | Porter et al. . |
| 5,722,460 | 3/1998 | Olsen et al. . |
| 5,785,087 | 7/1998 | Takahashi et al. . |
| 5,799,696 | 9/1998 | Weiss . |

FOREIGN PATENT DOCUMENTS

| | | |
|---|---|---|
| 1-105083 | 4/1989 | (JP) . |

*Primary Examiner*—Gerald A. Michalsky
(74) *Attorney, Agent, or Firm*—Franklin Gubernick

(57) ABSTRACT

A direct-drive, backlash-free servovalve in which the tip of an electric motor continually engages opposite sides of a receiving groove in the valve spool. The tip has a trapezoidal cross-section and tapers downwardly toward its extreme end. Rotation of the tip causes a translation of the valve spool, and can only progress until a side of the tip jams against one of the groove's sidewalls.

22 Claims, 3 Drawing Sheets

SERVOVALVE HAVING A TRAPEZOIDAL DRIVE

FIELD OF THE INVENTION

The invention is in the field of motor-driven valves. More particularly, the invention is a direct-drive servovalve in which a drive motor is employed to cause a substantially backlash-free shifting of the valve's spool. This is accomplished through the use of a uniquely-shaped tip of the motor's output shaft and a shaped groove in the valve's spool that receives said tip. To enhance engagement between the tip and groove, the shaft is spring-biased toward the spool. Furthermore, the geometric relationship between the tip and groove is also responsible for limiting the rotation of the motor.

BACKGROUND OF THE INVENTION

It is well known to use an electric motor to cause a shifting of a servovalve's spool. This is usually accomplished through a mechanical link that converts the rotary motion of the motor's output shaft into a linearly-directed force that acts on the valve's spool. One example of such a mechanical link is an offset tip of the motor's shaft engaging a groove/aperture in the spool. In this manner, rotation of the shaft causes the tip to move in an arc, thereby applying a force on the spool that is at least partially directed along the spool's longitudinal axis.

One problem with a mechanical link that employs an offset tip of the motor's shaft is that there can be significant backlash in the connection between the tip and the valve. This is usually due to the tip having a single linear contact with the shaped groove/aperture in the valve's spool. When the rotation of the motor's shaft is reversed, any play whatsoever between the tip and the sides of the spool's groove/aperture will allow the tip to move without a concomitant movement of the spool.

One method used in the prior art to overcome the above-noted problem is to fully retain the shaft's tip within a bushing located in the spool's receiver. This is taught by Spurbeck in U.S. Pat. No. 4,573,494. However, this is only a temporary solution since backlash will arise as soon as the bushing wears. In addition, the extra parts increase the valve's cost and maintenance requirements.

A second problem with prior art direct-drive valves is that it is both necessary and extremely difficult to precisely limit the amount of rotational movement of the drive motor's shaft. When a valve's spool is shifted due to a rotational movement of a drive motor's shaft, the amount of rotation determines the length of the valve's stroke (translation of the spool). If the motor's shaft rotates to a lesser or greater extent than is required, the spool may not shift a full stroke, or will shift too far, or may even shift a full stroke and then reverse direction and partially retrace its path. Therefore, precisely limiting the motor's rotation is absolutely critical to proper valve function.

There have been a number of methods employed in the prior art to limit the amount of rotation of the motor's output shaft. Most commonly, the motor includes internal stops that stop the rotor's movement. However, the stops can break or wear, resulting in improper rotation of the motor's shaft.

Another method for limiting the rotation of the motor's output shaft is taught by Hair et al in U.S. Pat. No. 5,040,568. The patent teaches the use of a shaped cam plate that is attached to the tip portion of the motor's shaft. When the motor is attached to the valve body, the plate is received within a specially-shaped cavity in the valve body. As the tip rotates, it causes the plate to shift within the cavity. The tip movement, and hence the motor's rotation, is stopped when a side of the plate abuts a sidewall of the cavity. While this is an effective method for limiting the rotation of the motor, it requires the use of a cam plate that must be precisely machined and secured to the shaft in a slip-free manner. Furthermore, the body of the valve must include a precisely machined cavity for receiving the plate. Once the plate is within the cavity, the cavity must remain free of corrosion and dirt, since any foreign material on the contact surfaces would adversely affect proper operation of the valve. In addition, any wear of the cam plate, of the connection between the plate and shaft, or of the cavity's sidewalls will result in inaccurate movement of the valve's spool. Additionally, the added parts and precise machining increase the valve's cost and its maintenance requirements.

SUMMARY OF THE INVENTION

The invention is a direct-drive servovalve that employs a unique method to convert the rotation of the drive motor's output shaft into a linear translation of the valve's spool. The method involves a trapezoidally-shaped tip of the output shaft engaging opposite sidewalls of a shaped groove in the valve's spool. The resultant geometric relation enables the conversion of a rotational movement of the tip into a linear movement of the spool. Furthermore, the geometry of the contacting surfaces also acts to limit the rotation of the motor's shaft.

The motor is preferably of the type commonly known as a torque motor and has a conventional stator and rotor. However, the tip portion of the motor's shaft has a trapezoidally-shaped cross-section and tapers down to a truncated end. Unlike the offset tips of the prior art, the longitudinal axis of the shaft extends through the center of the tip. The motor's shaft is allowed some longitudinal play, and a spring member or mechanism is employed to continually urge the shaft's tip toward the valve.

While the invention can be used with any type of valve in which operation of the valve requires a linear translation of a portion of the valve, the invention is preferably employed with a conventional spool valve. The spool is modified whereby it has a receiver designed to inwardly-receive at least a portion of the trapezoidal tip. In the preferred embodiment, the receiver is in the form of a circumferential groove that has tapered, flat sidewalls and a depth capable of receiving at least a portion of the trapezoidal tip. The taper of the groove's sidewalls is complementary to the taper of the tip whereby opposite sides of the tip can engage opposite sidewalls of the groove.

When the trapezoidal tip of the motor's shaft is received within the spool's groove, an area of contact is continuously maintained along opposite sides of the tip. This is due to the geometry of the contacting parts, and is enhanced by the spring in the motor that urges the shaft toward the spool. As a result, a substantially zero-backlash engagement between the two components is maintained throughout any operational movements of the valve's spool.

Once the tip and spool are engaged, rotation of the motor's shaft will cause the tip to press on the groove's sidewalls in a manner that causes a translation of the spool. The spool will shift an amount related to the angle of the tip's sides relative to the groove's sidewalls.

The translation will continue until an entire face of one side of the tip is parallel to and abuts the adjacent sidewall of the groove. Once this occurs, the tip cannot rotate any further, thereby stopping the rotation of the motor at a precise and predetermined point. This avoids the need for any additional structure to accomplish a limiting of the motor's rotation.

Therefore, the geometry of contact between the tip of the motor's shaft and the receiver in the spool provides a backlash-free connection and negates the need for any additional structure to limit the rotation of the motor. This results in a direct-drive servovalve that is low in cost and requires only a minimum of maintenance.

DETAILED DESCRIPTION OF THE DRAWINGS

Figure 1:
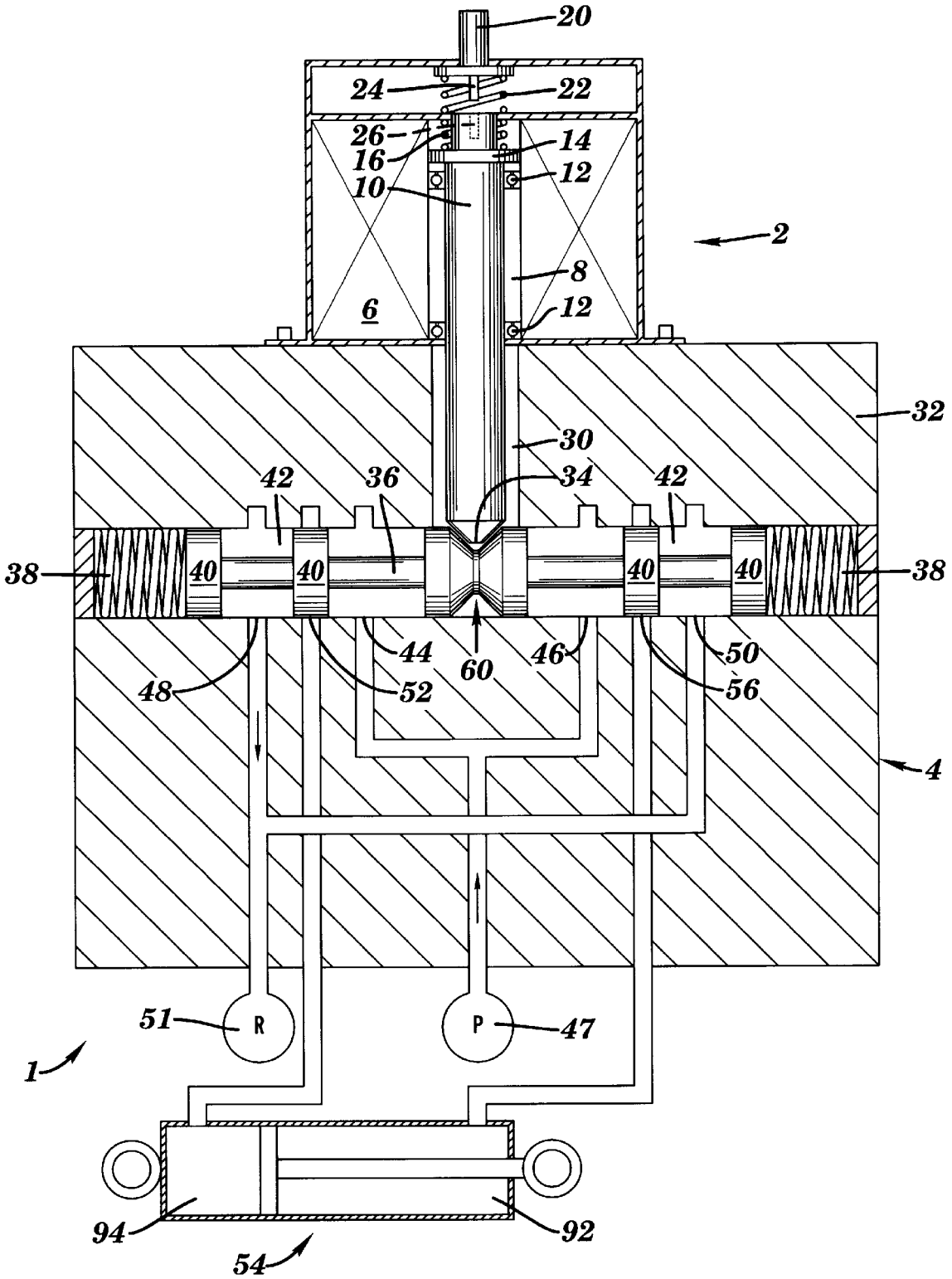
FIG. 1 is a sectional and partial schematic view of a generalized direct-drive servovalve in accordance with the invention.

Referring now to the drawings in greater detail, wherein like characters refer to like parts throughout the several figures, there is shown by the numeral 1 a direct-drive servovalve in accordance with the invention. The portions of the servovalve that are non-critical to the explanation of the invention are not shown in detail.

The servovalve includes a motor 2 and a spool valve 4. The motor and spool valve are preferably bolted together to form a single unit.

The motor 2 is preferably a torque motor, and includes a stator 6 and rotor 8. The center of the rotor forms the motor's output shaft 10. The shaft is centered and rotatably secured by two bearings 12. A flange portion 14 of the shaft engages a spring element 16, preferably in the form of a coil spring. Other forms of a spring element can alternatively be employed, including a spring member such as wave or belville washer, or a spring mechanism such as a gas spring. The output shaft preferably is allowed a small amount of axial play, and the spring element 16 functions to continually urge the shaft toward the valve 4.

Located at the top of the motor is a knob 20 that is outwardly-biased by a spring element 22 in the form of a coil spring. Other forms of a spring element can alternatively be employed, including a spring member such as wave or belville washer, or a spring mechanism such as a gas spring. The bottom of the knob includes a tang 24 having flat sides. A user can press down on the knob and cause the tang to enter a complementary receiving aperture 26 located in the top end of the shaft. Once so engaged, a user can then manually rotate the shaft 10 by rotating the knob. Once the user stops applying downward pressure on the knob, spring element 22 will move the knob outwardly and disengage the tang from the shaft 10.

The motor's shaft 10 has a length whereby it protrudes outwardly from the bottom of the motor and enters a cavity 30 in the body 32 of the valve 4. The end of the shaft includes a shaped tip 34.

The valve 4 is shown in a generalized form in FIG. 1. The valve features a translatable spool or slide 36 that can move in a linear fashion in a direction perpendicular to the longitudinal axis of the motor's output shaft 10. The valve has springs 38 that press on associated ends of the spool to thereby urge the spool to a center position. The spool includes lands 40 that can sealingly mate with the wall of bore 42. Located in the wall of the bore 42 are a number of ports, including ports 44 and 46 that lead to a pump or other source 47 of pressurized fluid (shown in schematic form in FIG. 1), and return ports 48 and 50 that lead to a fluid sump or reservoir 51(shown in schematic form in FIG. 1). There is also a port 52 that leads to one portion of a load, such as the hydraulic cylinder 54 shown in generalized form in FIG. 1. The valve also includes a port 56 that leads to another portion of the load/hydraulic cylinder 54. Translation of the spool connects various of the valve's ports to the load 54, in the conventional manner well-known in the art.

Located in the center of the spool 36 is a circumferential groove 60. The shaped tip 34 of the motor's output shaft fits into the groove 60.

Figure 2:
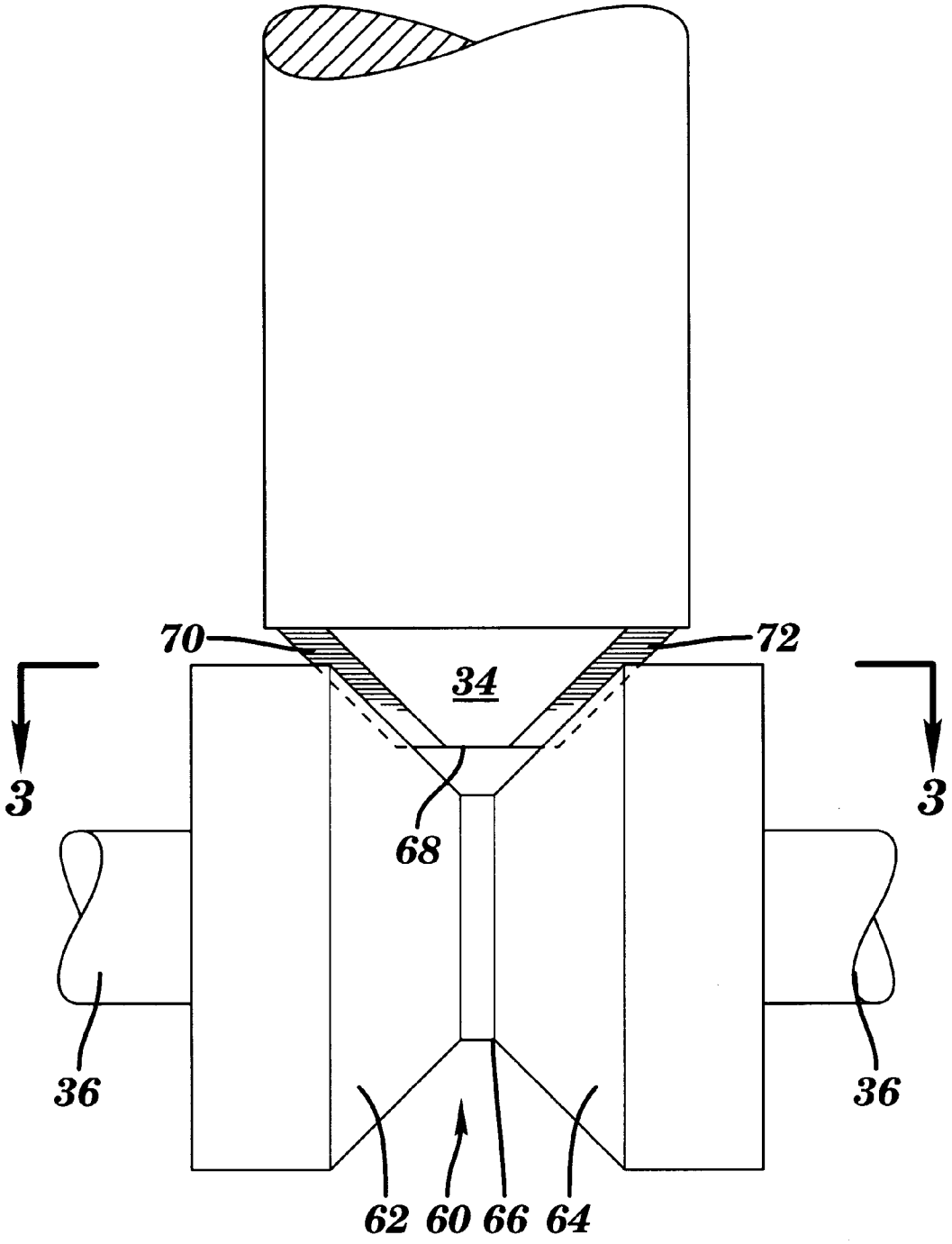
FIG. 2 is a detailed, magnified view of the area in FIG. 1 in which the motor's shaft engages the valve's spool.

FIG. 2 provides a magnified view of the servovalve 1 in the area where the tip 34 engages groove 60. As can be seen in the figure, the groove is continuous about the circumference of the spool and has flat sidewalls 62 and 64. The sidewalls are at an angle relative to an axis perpendicular to the spool's longitudinal axis. In the preferred embodiment, the sidewalls are at an angle of approximately forty-five to sixty degrees from an axis perpendicular to the spool's longitudinal axis.

While groove 60 is shown as a continuous circumferential groove, a non-continuous groove can alternatively be employed if the spool will be maintained in a stable orientation. A groove is hereby broadly defined as any break in the surface of the spool capable of at least partially receiving the tip 34 of the shaft. Therefore, the groove can extend 360 degrees about the circumference of the spool, extend partially about the circumference (less than 360 degrees) of the spool, or even be a shaped aperture/bore in the spool, such as a rectangular opening.

As shown in FIG. 2, the center of the groove has a flat base or floor 66. In the preferred embodiment, the tip 34 only engages the sidewalls of the groove, and does not contact the floor 66.

As can also be seen in FIG. 2, the tip 34 tapers downwardly to its end 68, and has sides 70 and 72 that are adjacent sidewalls 62 and 64 of the groove, respectively. One should note that this figure shows the valve in a neutral position, wherein the spool is centered in the valve body and pressurized fluid is not being directed to the load. At the position shown, each of the tip's sides 70 and 72 faces, but is not parallel to, the adjacent sidewall of the groove.

Figure 3:
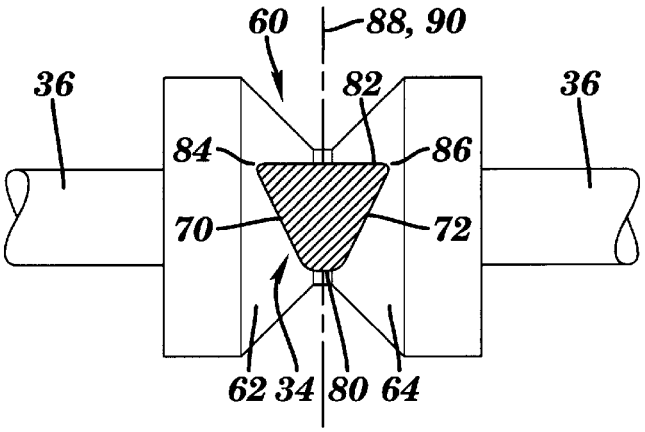
FIG. 3 is a plan, partial cross-sectional view of the area shown in FIG. 2, taken at the plane labeled 3—3 in FIG. 2.

FIG. 3 provides a plan view of the tip 34 fitting into the groove 60, at the position shown in FIG. 2. Since this view is taken from a position approximately even with the top of the groove's sidewalls, the tip 34 is shown in cross-section. One can see in this view that each of the tip's sides 70 and 72 angle outwardly from the tip's narrow front face 80 to the tip's wide rear face 82. In the neutral position, only the rear corners, 84 and 86 of the tip, or the area of the tip's sides near said corners, contact the groove's sidewalls 62 and 64 respectively. The spring 16 of the motor applies a continual downward force on the motor's shaft so that the tip will always lightly press on, and maintain contact with, the sidewalls of the groove. In the position shown, an included angle is created between either side of the tip and the adjacent sidewall of the groove.

Also shown in FIG. 3 is an imaginary plane 88 that passes through the midpoint of the spool, and another imaginary plane 90 that bisects the tip 34 and shaft 10. One should note that the in the position shown in this view, the planes are colinear.

Figure 4:
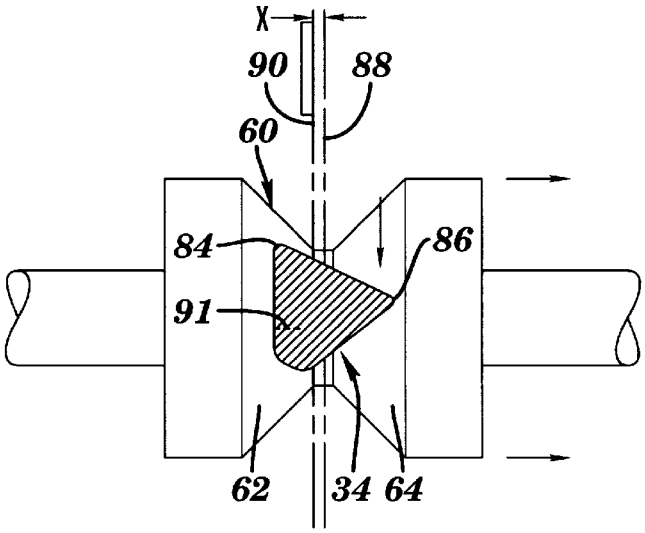
FIG. 4 is a view similar to FIG. 3, that shows the resultant configuration after the spool has been shifted to the right due to a clockwise rotation of the shaft.

FIG. 4 shows the tip and spool at a point after the motor's shaft has rotated the maximum amount allowable in a clockwise direction. As the tip rotated to reach the point shown, corner 86 of the tip slid in the direction indicated by the arrow along the face of the groove's sidewall 64. At the same time, corner 84 of the tip slid along the groove's sidewall 62 in the opposite direction. The rotation of the motor's shaft was stopped when side 70 became parallel to sidewall 62, and a new area of contact was created between side 70 and sidewall 62. Since side 70 and sidewall 62 have complementary tapers, the two surfaces will contact each other along a line, indicated as 91 in FIG. 4. The line of contact is parallel to side 70 and sidewall 62, and in FIG. 4, is spaced from corner 84. A linear contact is preferred since a larger contact area reduces any possibility for backlash and minimizes any upward thrust on the shaft 10. It should be noted that while not preferred, the invention will still function if only point contact is made between the side of the tip and the sidewall of the groove.

As can be seen by the locations of the planes 88 and 90, the movement of the tip also caused the spool to shift an amount 'X' to the right. One should note that for the structure shown, distance 'X' is related to the included angle between the side 70 and sidewall 62 prior to the rotation, and can be changed by using a shaft 10 that has a tip in which the faces 80 and 82 are proportionally different in width. The shifting of the spool is preferably of a sufficient amount to allow pressurized fluid to flow through the valve whereby it is directed to area 92 of the cylinder 54. In the conventional manner of spool valves, the valve will simultaneously enable the return flow of fluid from cylinder area 94 to the reservoir. One should note that in FIG. 1, the spacing between the valve's ports is exaggerated for clarity of viewing.

The motor 2 preferably includes a potentiometer/pot-type sensor (not shown) that is connected to the shaft 10. The sensor measures any rotation of the shaft and thereby effectively indicates the position of the spool 36. Furthermore, as the shaft rotates, the motor's spring element 16 will also act to absorb any forces directed along the longitudinal axis of the shaft by allowing some longitudinal movement of the shaft.

Once the desired movement of the piston of cylinder 54 has been achieved, the torque motor is deactivated, and the spool and tip return to the position shown in FIGS. 1–3 due to the centering springs 38 located in the valve body.

Figure 5:
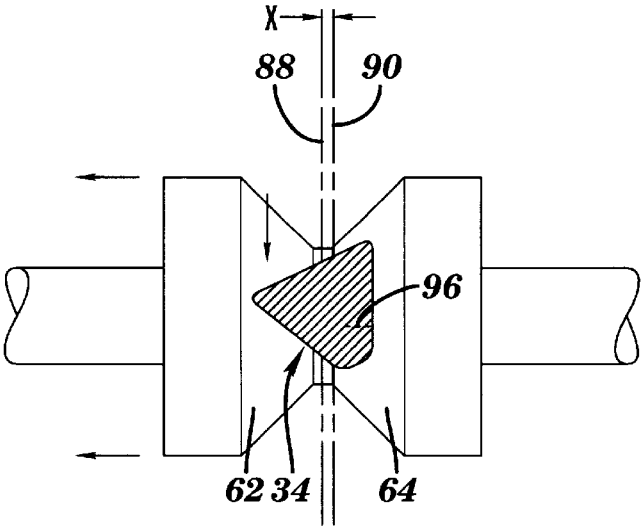
FIG. 5 is a view similar to FIG. 3, that shows the resultant configuration after the spool has been shifted to the left due to a counter-clockwise rotation of the shaft.

FIG. 5 shows the tip and center portion of the spool at a point when the motor's shaft has rotated the maximum allowable amount in a clockwise direction from the position shown in FIG. 3. As the tip rotated, corner 84 of the tip slid in the direction indicated by the arrow along the face of the groove sidewall 62. At the same time, corner 86 of the tip slid along the groove's sidewall 64 in the opposite direction. The rotation of the motor's shaft was stopped when side 72 became parallel to sidewall 64 of the groove, and a new line of contact 96 was achieved between the two surfaces. One should note that the line of contact 96 is located at an area spaced from the initial line of contact at, or near, corner 86. It should be noted that while a linear contact is preferred, a point contact will still allow the basic functionality of the invention.

As can be seen in FIG. 5, the movement of the tip also caused the spool to shift an amount 'X' to the right. The shifting of the spool allows pressurized fluid to flow through the valve and be directed to cylinder area 94. In the conventional manner of spool valves, the return flow of fluid from cylinder area 92 goes through the valve and is thereby directed to the reservoir. Once the desired movement of the cylinder's piston has been achieved, the torque motor is deactivated, and the spool and tip return to the position shown in FIG. 3 due to the centering springs 38.

It should be noted that while a specific type of valve has been generically shown and described, the direct-drive mechanism can be used with other forms of spool valves, or with any other type of valve in which a portion of the valve is required to be moved in a linear fashion. Furthermore, while a torque motor has been shown and described, other types of electrical motors having a rotatable output shaft may be substituted in its place, as long as the shaft's tip has a shape in accordance with the invention. Furthermore, while specific angles of the tip's sides and the groove's sidewalls have been shown and described, other angles may instead be employed, as long as the geometric relation between the tip's sides and the groove's sidewalls is maintained. While the tip is shown having flat sides 70 and 72, non-flat sides can be employed, as long as spaced portions of each side can be brought into contact with an adjacent sidewall of the groove through a rotation of the tip. For example, the tip can have an 'X'-shaped cross-section, as long as the "bottom" of the 'X' is narrower than the "top" of the 'X'.

The preferred embodiment of the invention disclosed herein has been discussed for the purpose of familiarizing the reader with the novel aspects of the invention. Although a preferred embodiment of the invention has been shown and described, many changes, modifications and substitutions may be made by one having ordinary skill in the art without necessarily departing from the spirit and scope of the invention as described in the following claims.

I claim:

1. A direct-drive servovalve comprising:

an electric motor, wherein said motor includes a rotatable output shaft having a tip;

a valve having a translatable spool and a plurality of ports, wherein movement of the spool can enable pressurized fluid to travel from at least one of said ports to another of said ports, wherein said spool has a longitudinal axis that is oriented substantially perpendicular to a longitudinal axis of said output shaft of said motor; and wherein said spool includes a groove having sidewalls, wherein at least a portion of said tip is received within said groove, wherein said tip has a trapezoidal cross-section, wherein when said shaft is in a first position, opposite sides of said tip will face adjacent sidewalls of said groove but be non-parallel to said sidewalls, wherein a partial rotation of said shaft from said first position will cause a translation of said spool, wherein rotation of said shaft is stopped when one of said sides of said tip become substantially parallel to, and abuts, one of the sidewalls of the groove.

2. The servovalve of claim 1 wherein said motor includes a spring element that urges said output shaft of the motor toward the spool.

3. The servovalve of claim 1 wherein said spool has a circumference and said groove extends completely about said circumference of said spool.

4. The servovalve of claim 1 wherein said motor includes a manually-actuable mechanism that enables a user to manually rotate the motor's output shaft.

5. The servovalve of claim 4 wherein said manually-actuable mechanism includes a spring element that urges at least a portion of said mechanism away from said output shaft of said motor.

6. The servovalve of claim 1 wherein said tip has a distal end, wherein said groove has a center surface that extends between said sidewalls of said groove, and wherein said sidewalls of said groove are angled relative to adjacent sides of said tip whereby the distal end of the tip cannot contact said center surface of said groove.

7. The servovalve of claim 1 wherein when said valve is in a neutral condition, said spool will be at a centered position and opposed corner portions of said tip will be contacting the adjacent sidewalls of said groove.

8. The servovalve of claim 1 wherein the groove in said spool is situated substantially equidistant from opposite ends of said spool.

9. The servovalve of claim 1 wherein the maximum allowable rotation of said shaft is no more than 180 degrees from said first position, said rotation being stopped when spaced portions of said tip abut the sidewalls of said groove.

10. A direct drive valve comprising:

an electric motor, wherein said motor includes a rotatable output shaft having a tip;

a valve having a movable member and a plurality of ports, wherein movement of said member can enable pressurized fluid to travel from at least one of said ports to another of said ports, wherein said member can move in a direction perpendicular to a longitudinal axis of said output shaft of said motor; and wherein said member includes a groove having first and second sidewalls, wherein at least a portion of said tip is received within said groove, wherein a cross-section of said tip, taken in a plane perpendicular to the longitudinal axis of said shaft, has a substantially trapezoidal shape including first and second sides, a major base, and a minor base, wherein first and second stops limit the rotation of said tip, wherein said first stop occurs when said first side is parallel to and abuts said first sidewall, wherein said second stop occurs when said second side is parallel to and abuts said second sidewall, and whereby a partial rotation of said shaft will cause said tip to apply force to said movable member of said valve and thereby cause said member to move in a linear manner from a first position to a second position.

11. The direct-drive valve of claim 10 wherein said tip has an end and wherein said tip tapers down toward said end.

12. The direct-drive valve of claim 10 wherein said valve is a servovalve and said member of said valve is a translatable spool.

13. The direct-drive valve of claim 10 wherein the first side of said tip includes a first portion adjacent said major base, wherein said second side of said tip includes a first portion adjacent said major base, and wherein when said valve is in a neutral condition in which pressurized fluid is not flowing through said valve, the first side's first portion is contacting said first sidewall and said second side's first portion is contacting said second sidewall.

14. The direct-drive valve of claim 10 wherein said motor includes a spring element that urges said output shaft of the motor toward the movable member of the valve.

15. A direct-drive servovalve comprising:

an electric motor, wherein said motor includes a rotatable output shaft having a tip portion;

a spool valve having a translatable spool and a plurality of ports, wherein movement of the spool can enable pressurized fluid to travel from at least one of said ports to another of said ports, wherein said spool has a longitudinal axis that is oriented substantially perpendicular to a longitudinal axis of said output shaft of said motor; and wherein said spool includes a receiver in the form of a shaped area having first and second sidewalls, wherein at least a portion of said tip portion is received within said receiver between said sidewalls, wherein said tip portion has first and second sides, wherein when said tip portion is in a first position, a first part of said first side will contact said first sidewall, and a first part of said second side will contact said second sidewall, wherein when said shaft rotates in a first direction, pressure will be applied to said spool by the tip portion's first side and thereby cause a linear movement of said spool, wherein rotation of said shaft in said first direction will be stopped when a second part of said second side contacts said second sidewall.

16. The servovalve of claim 15 wherein when said shaft rotates in a second direction, pressure will be applied to said spool by said first part of the tip portion's second side and thereby cause a linear movement of said spool, and wherein rotation of said shaft will be stopped when a second part of said first side contacts said first sidewall.

17. The servovalve of claim 16 wherein the first part of the tip portion's first side is spaced from the first part of the tip portion's second side by a first distance, wherein the second part of the tip portion's first side is spaced from the second part of the tip portion's second side by a second distance, and wherein said first distance is greater than said second distance.

18. The servovalve of claim 15 wherein a spring element functions to continually urge the motor's shaft toward the spool.

19. A direct-drive valve comprising:

a motor, wherein said motor includes a rotatable output shaft having a tip portion;

a valve having a movable member and a plurality of ports, wherein movement of said member can enable pressurized fluid to travel from at least one of said ports to another of said ports, wherein said movable member can move in a direction substantially perpendicular to a longitudinal axis of the motor's output shaft; and wherein said movable member includes a receiver in the form of a shaped area in said member and has first and second sidewalls, wherein at least a portion of said tip portion is received within said receiver, wherein said tip portion has first and second sides, wherein when said tip portion is in a first position, a first part of said first side will contact said first sidewall, and a first part of said second side will contact said second sidewall, wherein when said shaft rotates in a first direction, pressure will be applied to said movable member by said first part of the tip portion's first side and thereby cause a linear movement of said member, wherein rotation of said shaft in said first direction will be stopped when a second part of said second side contacts said second sidewall.

20. The direct-drive valve of claim 19 wherein when said shaft rotates in a second direction, pressure will be applied to said movable member by said first part of the tip portion's second side that will cause a linear movement of said member, wherein rotation of said shaft will be stopped when a second part of said first side contacts said first sidewall, and wherein the first part of the tip portion's first side is spaced from the first part of the tip portion's second side by a first distance, wherein the second part of the tip portion's first side is spaced from the second part of the tip portion's second side by a second distance, and wherein said first distance is greater than said second distance.

21. The direct-drive valve of claim 19 wherein a spring element functions to continually urge the motor's shaft toward the valve's movable member.

22. The direct-drive valve of claim 19 wherein the first and second sides of said tip portion are tapered, wherein said first and second sidewalls of said receiver are each angled to be complementary to the taper of the contacting side of the tip portion, whereby contact between the sides of the tip portion and the sidewalls of the receiver will be linear.

* * * * *